US006354886B1

(12) United States Patent
Yu

(10) Patent No.: US 6,354,886 B1
(45) Date of Patent: Mar. 12, 2002

(54) ELECTRICAL CONNECTOR

(75) Inventor: Wei-Ting Yu, Taipei Hsien (TW)

(73) Assignee: Advanced Connecteck Inc., Hsintien (TW)

( * ) Notice: Subject to any disclaimer, the term of this patent is extended or adjusted under 35 U.S.C. 154(b) by 0 days.

(21) Appl. No.: 09/657,488

(22) Filed: Sep. 8, 2000

(51) Int. Cl.[7] ..... H01R 13/502
(52) U.S. Cl. ..... 439/701; 439/660
(58) Field of Search ..... 439/701, 660, 439/607–610

(56) References Cited

U.S. PATENT DOCUMENTS 5,975,917 A * 11/1999 Wang et al. ..... 439/701
5,980,325 A * 11/1999 Horchler ..... 439/701
6,162,068 A * 11/1999 Wu ..... 439/701
6,039,611 A * 3/2000 Yang ..... 439/701

* cited by examiner

*Primary Examiner*—Gary F. Paumen
(74) *Attorney, Agent, or Firm*—Merchant & Gould P.C.

(57) ABSTRACT

An electrical connector includes a first terminal module having a row of first terminals and an insulative first seat body molded over the first terminals, a second terminal module having a row of second terminals and an insulative second seat body molded over the second terminals, a coupling member disposed on and coupling the first and second seat bodies, an insulative housing having a sleeve portion receiving the first and second terminal modules, a retaining member disposed on the housing for positioning the first and second seat bodies to the housing, and a metal shield surrounding the sleeve portion.

12 Claims, 6 Drawing Sheets

ELECTRICAL CONNECTOR

BACKGROUND OF THE INVENTION

1. Field of the Invention

This invention relates to an electrical connector, more particularly to an electrical connector having rows of terminals and insulative bodies molded over the terminals.

2. Description of the Related Art

FIGS. 1 and 2 illustrate a conventional electrical connector for high frequency data transmission. The connector includes an insulative seat body 10 having a sleeve portion 100 with front and rear open ends 101, 103, and a terminal positioning panel 13 extending through the sleeve portion 100 and having a front mating portion 105 projecting frontwardly from the front open end 101, a pair of opposite rear connecting portions 107 projecting rearwardly from the rear open end 103, and two opposite rows of terminal passageways 106 formed in two opposite sides thereof and extending from the front mating portion 105 to the rear connecting portions 107. A plurality of terminals 14 are respectively received in the terminal passageways 106, and are exposed at the front mating portion 105 and the rear connecting portions 107. A metal shield 11 is mounted on the sleeve portion 100, and surrounds the mating portion 105 for protecting the terminals 14 on the terminal positioning panel 13 and for diminishing electromagnetic interference (EMI).

Since each terminal 14 is to be snugly inserted in the respective passageway 106, there is a tendency for the terminals 14 to be bent during assembly. Moreover, it is laborious and requires lots of manpower to insert the terminals 14 into the passageways 106.

SUMMARY OF THE INVENTION

Therefore, the object of the present invention is to provide an electrical connector that is capable of overcoming the aforementioned drawbacks.

According to the present invention, an electrical connector comprises a first terminal module including a row of first terminals and an insulative first seat body molded over the first terminals, the first terminals having contact portions exposed at one side of the first seat body; a second terminal module including a row of second terminals and an insulative second seat body molded over the second terminals, the second terminals having contact portions exposed at one side of the second seat body, the second seat body being stacked on the first seat body with the sides respectively facing upward and downward; a coupling member disposed on and coupling the first and second seat bodies; an insulative housing having a sleeve portion receiving the first and second terminal modules, the contact portions of the first and second terminals projecting outwardly from the sleeve portion; a retaining member disposed on the housing for positioning the first and second seat bodies to the housing; and a metal shield surrounding the sleeve portion and the contact portions of the first and second terminals.

BRIEF DESCRIPTION OF THE DRAWINGS

In drawings which illustrate an embodiment of the invention.

DETAILED DESCRIPTION OF THE PREFERRED EMBODIMENT

Figure 1:
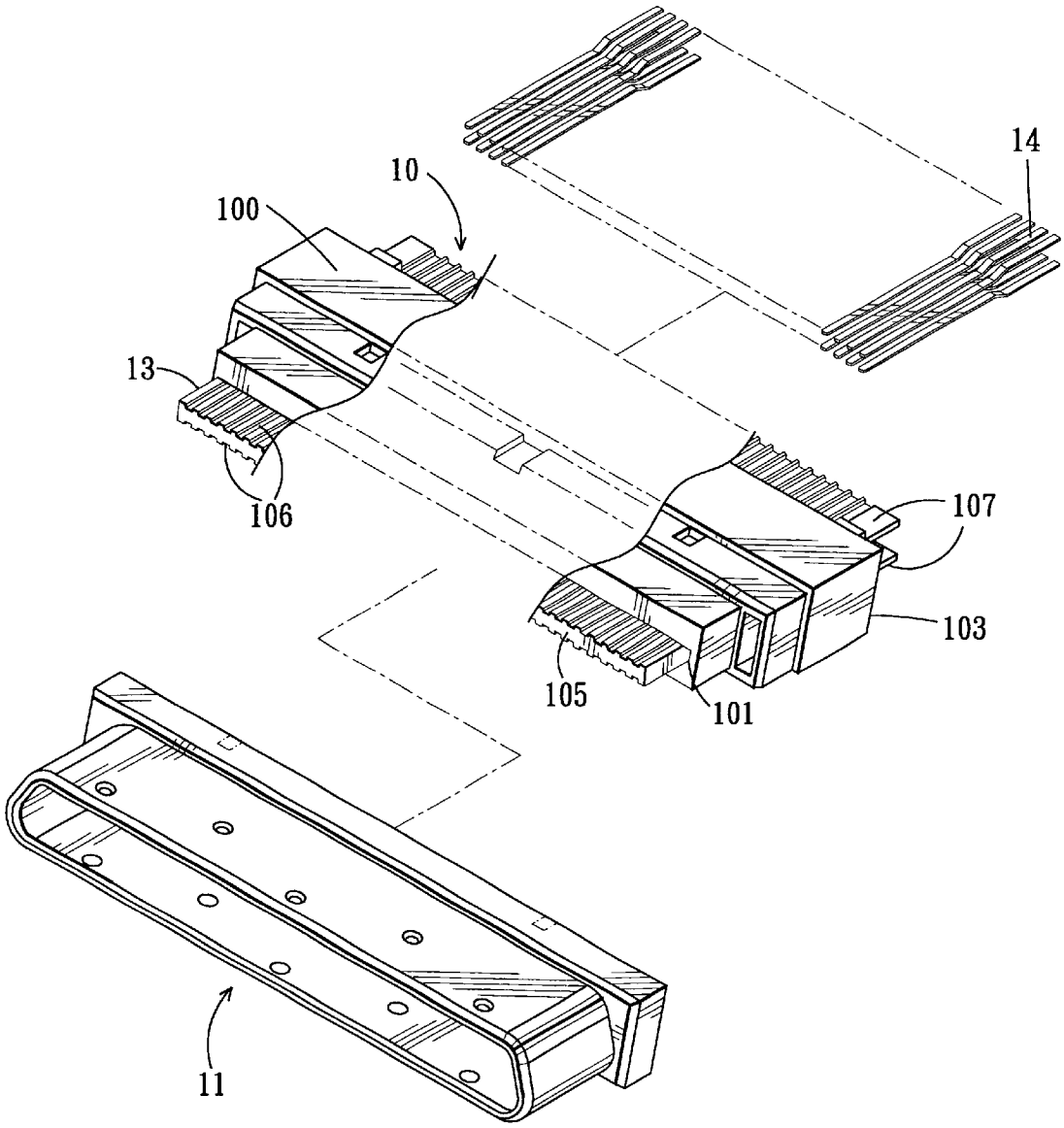
FIG. 1 PRIOR ART
FIG. 1 is an exploded perspective view of a conventional electrical connector.
Figure 2:
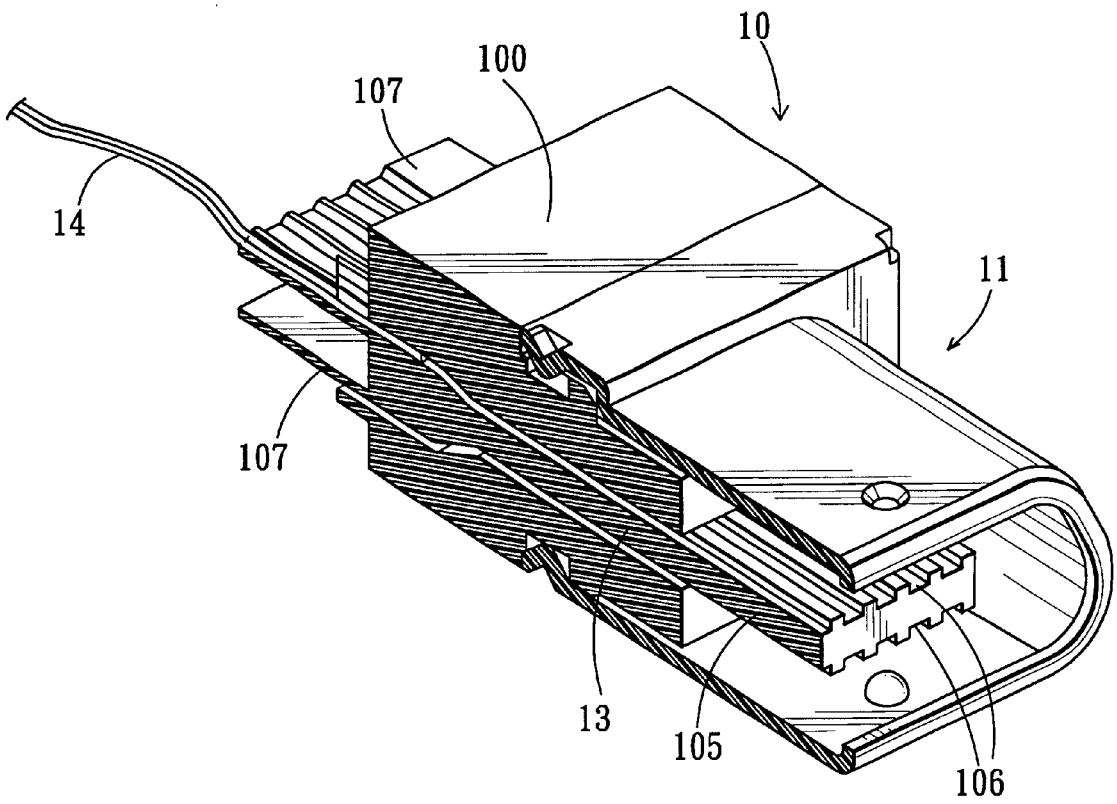
FIG.2 PRIOR ART
FIG. 2 is a cross-sectional side view of the electrical connector of FIG. 1.
Figure 3:
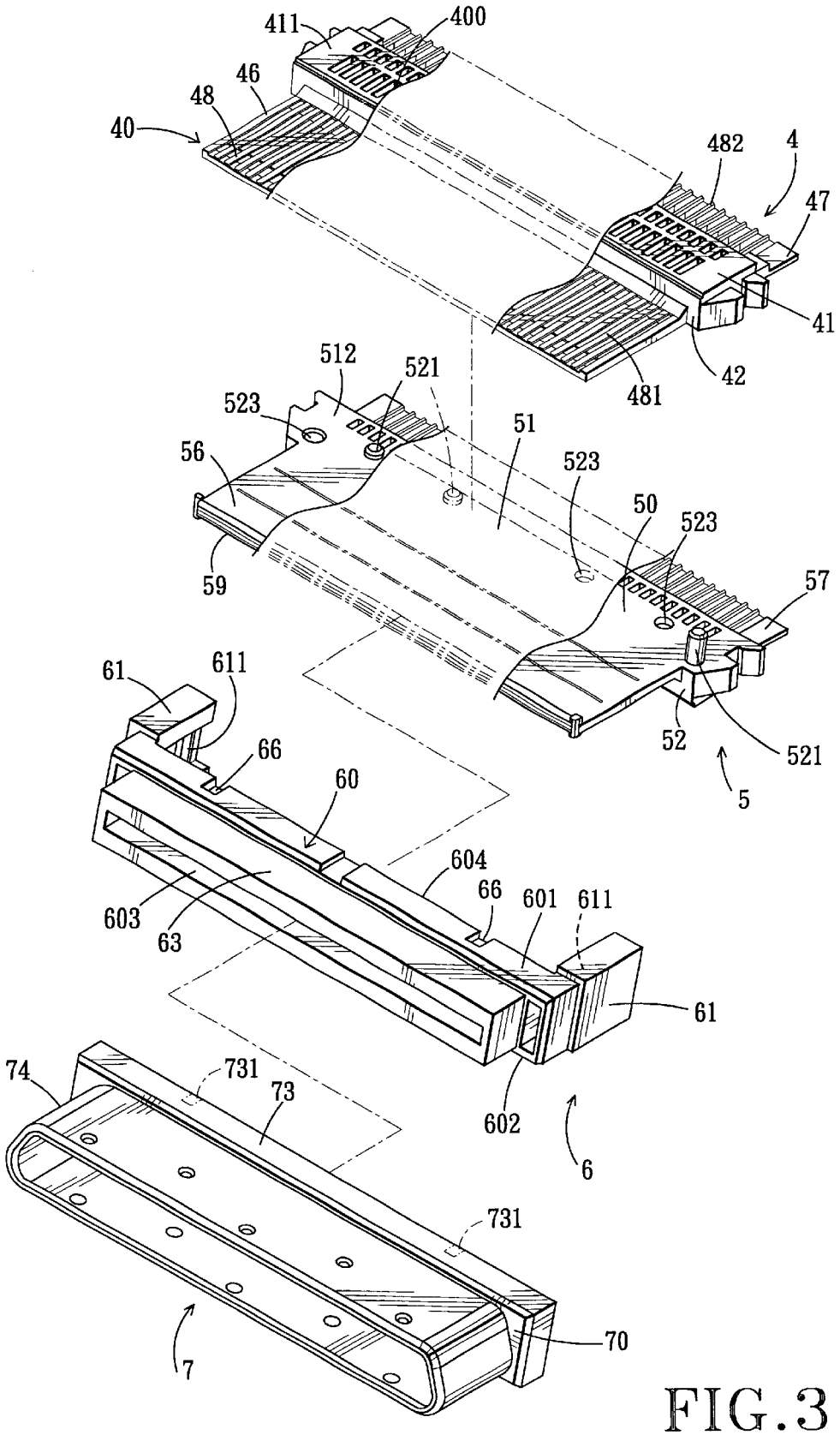
FIG. 3 is an exploded perspective view of an electrical connector embodying this invention.

FIG. 3 illustrates an electrical connector embodying this invention. The electrical connector includes complementary first and second terminal modules 4, 5, an insulative housing 6, and a metal shield 7.

Figure 4:
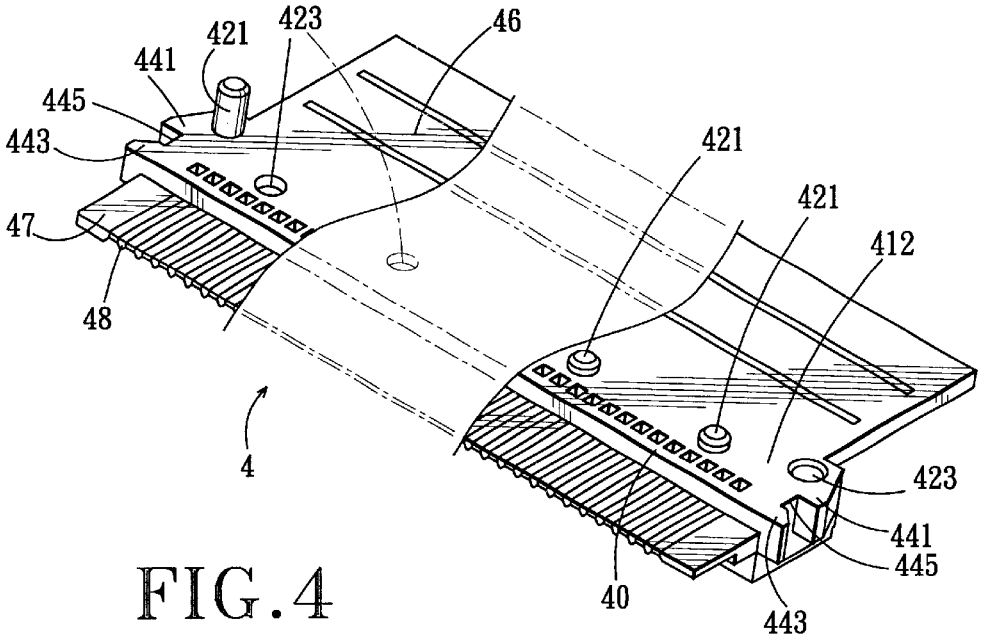
FIG. 4 is a perspective view of a first terminal module of the electrical connector of FIG. 3.

Referring now to FIG. 4, in combination with FIG. 3, the first terminal module 4 includes a row of first terminals 48, each having a front contact portion 481 and a rear connecting portion 482, and a one-piece insulative first seat body 40 molded over the first terminals 48 and having front and rear panel portions 46, 47 and a connecting portion 41 interconnecting the front and rear panel portions 46, 47. The front contact portions 481 and the rear connecting portions 482 of the first terminals 48 are respectively held by and are exposed at the front and rear panel portions 46, 47 at one side of the first seat body 40.

The connecting portion 41 of the first seat body 40 projects upwardly from the front and rear panel portions 46, 47 at the one side of the first seat body 40, and has a top side 411 above the front and rear panel portions 46, 47, a bottom side 412 opposite to the top side 411 and flush with bottom sides of the front and rear panel portions 46, 47, and a first front shoulder face 42 raising upwardly from one end of the front panel portion 46.

Figure 5:
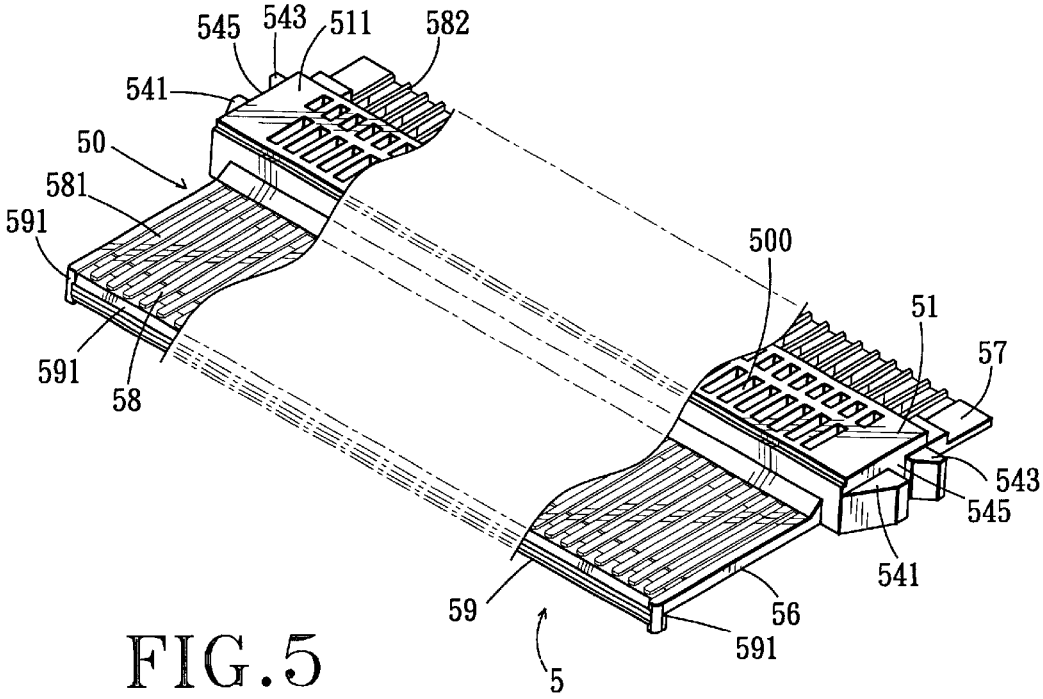
FIG. 5 is a perspective view of a second terminal module of the electrical connector of FIG. 3.
Figure 6:
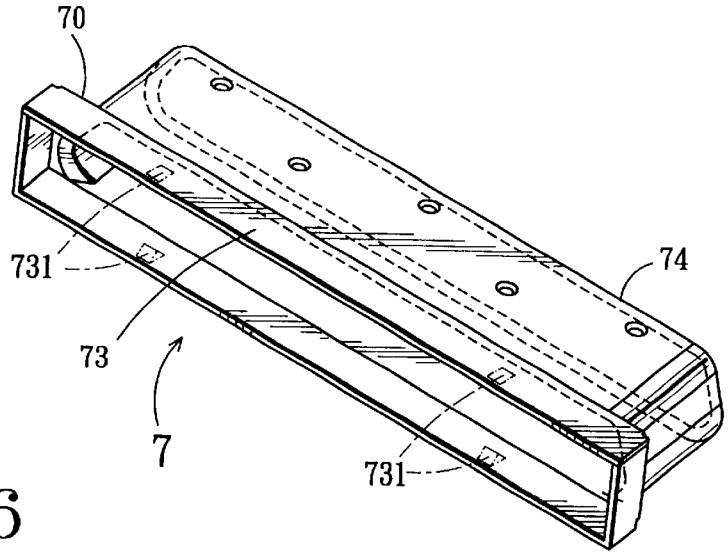
FIG. 6 is a perspective view of a metal shield of the electrical connector of FIG. 3.

Referring now to FIG. 5, in combination with FIG. 3, the second terminal module 5 includes a row of second terminals 58, each having a front contact portion 581 and a rear connecting portion 582, and a one-piece insulative second seat body 50 molded over the second terminals 58 and having front and rear panel portions 56, 57 and a connecting portion 51 interconnecting the front and rear panel portions 56, 57. The front contact portions 581 and the rear connecting portions 582 of the second terminals 58 are respectively held by and are exposed at the front and rear panel portions 56, 57 at one side of the second seat body 50.

The connecting portion 51 of the second seat body 50 projects downwardly from the front and rear panel portions 56, 57 at the one side of the second seat body 50, and has a bottom side 511 below the front and rear panel portions 56, 57, a top side 512 opposite to the bottom side 511 and flush with top sides of the front and rear panel portions 56, 57, and a second front shoulder face 52 projecting downwardly from a rear end of the front panel portion 56. The front panel portion 56 of the second seat body 50 has a front edge 59 flanged upwardly from front end thereof to a front end of the front panel portion 46 of the first seat body 40, and has a height substantially equal to the thickness of the front panel portion 46 of the first seat body 40. The front edge 59 of the front panel portion 56 of the second seat body 50 has a guide face 591 slanting upwardly and curvedly in a front-to-rear direction for guiding a complementary connector (not shown) and for protecting the front panel portions 46, 56 from being damaged by the complementary connector during engagement therewith.

A coupling member is disposed on and couples the first and second seat bodies 40, 50, and includes first and second projections 421, 521 respectively projecting from the bottom and top sides 412, 512 of the connecting portions 41, 51 of the first and second seat bodies 40, 50, and first and second recesses 423, 523 respectively formed in the bottom and top sides 412, 512 of the connecting portions 41, 51 of the first and second seat bodies 40, 50 and engageable with the second and first projections 521, 421.

Figure 7:
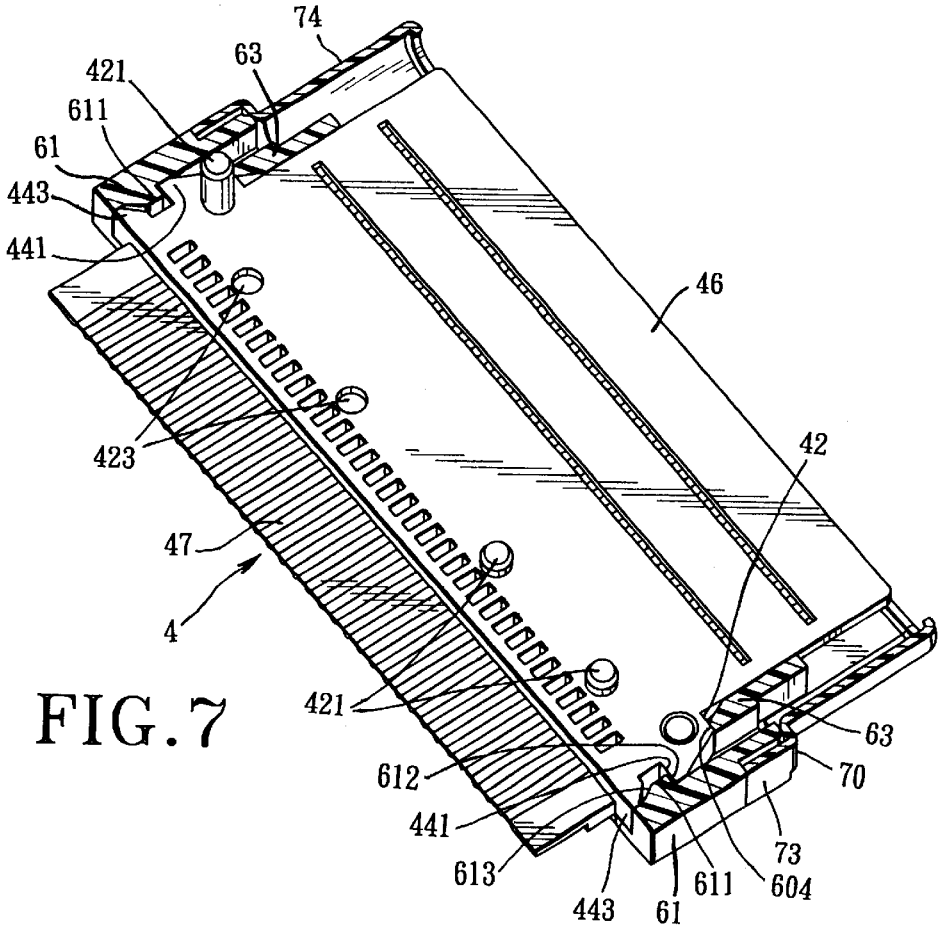
FIG. 7 is a cross-sectional top view of the electrical connector of FIG. 3.
Figure 8:
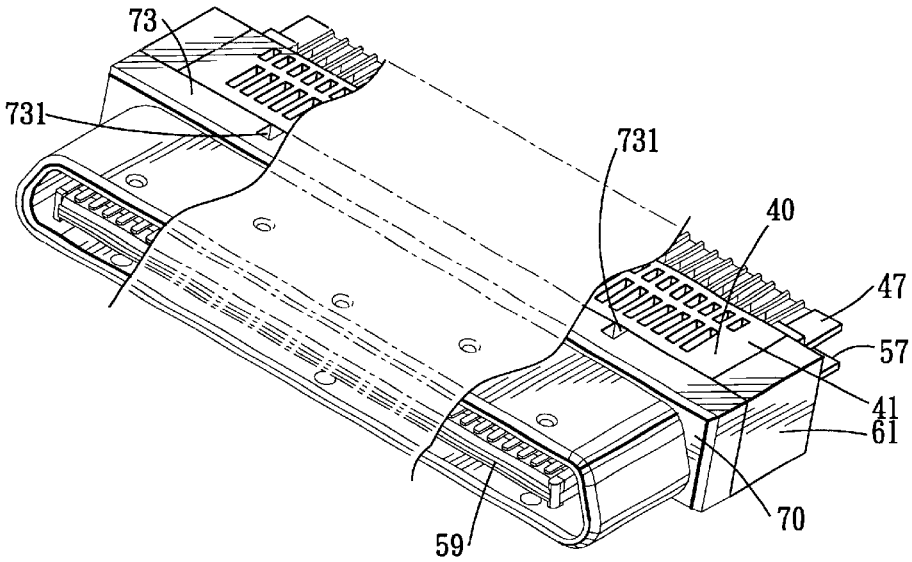
FIG. 8 is a perspective view of the electrical connector of FIG. 3.
Figure 9:
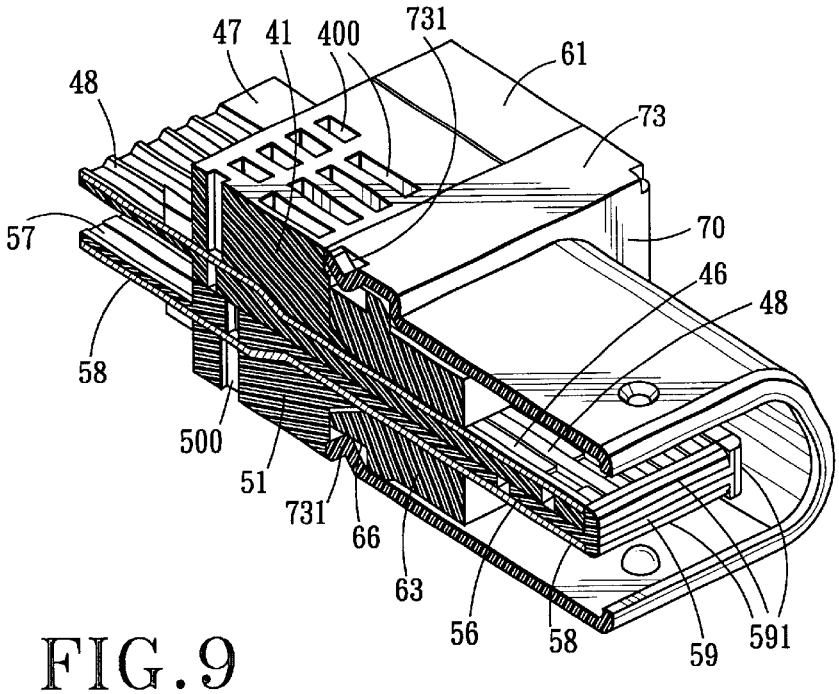
FIG. 9 is a cross-sectional side view of the electrical connector of FIG. 3.

Referring now to FIG. 7, in combination with FIGS. 3 to 5, the insulative housing 6 includes a sleeve portion 60 for receiving snugly the first and second terminal modules 4, 5, and having a top side 601 above the first terminal module 4, a bottom side 602 below the second terminal module 5, and front and rear open ends 603, 604. A reduced rectangular flange 63 projects frontwardly from the sleeve portion 60 to define the front open end 603. A pair of frame members 61 project rearwardly and respectively from the rear open end 604 at the opposite ends of the sleeve portion 60. The first and second front shoulder faces 42, 52 abut against the rear open end 604 of the sleeve portion 60 when the connecting portions 41, 51 of the first and second seat bodies 40, 50 are snugly inserted between the frame members 61 with the front and rear panel portions 46, 56, 47, 57 respectively projecting out of the front and rear open ends 603, 604 and with the top side 411 of the connecting portion 41 of the first seat body 40 flush with top sides of the frame members 61, and the bottom side 511 of the connecting portion 51 of the second seat body 50 flush with bottom sides of the frame members 61. A pair of locking recesses 66 are formed in each of the top and bottom sides 601, 602 of the sleeve portion 60.

A retaining member is disposed on the frame members 61 and the connecting portions 41, 51 of the first and second seat bodies 40, 50 for securing the first and second terminal modules 4, 5 to the insulative housing 6. The retaining member includes a pair of barb elements 611 respectively formed on and projecting inwardly and oppositely from the frame members 61. The barb elements 611 are spaced apart from the rear open end 604, and have shoulders 612 facing toward the rear open end 604, and slanting faces 613 extending rearwardly of the shoulders 612. The retaining member further includes first wedges 441, 541 respectively formed on and projecting outwardly from opposite side ends of each of the connecting portions 41, 51 of the first and second seat bodies 40, 50, and second wedges 443, 543 respectively formed on and projecting outwardly from the opposite side ends of each of the connecting portions 41, 51 of the first and second seat bodies 40, 50. The second wedges 443, 543 are disposed rearwardly of and are spaced apart from the first wedges 441, 541, and cooperate with the first wedges 441, 541 to form notches 445, 545 therebetween. The first wedges 441, 541 interlock with the shoulders 612 of the barb elements 611, and the second wedges 443, 543 abut against the slanting faces 613 of the barb elements 611 when the barb elements 611 project into the notches 445, 545.

Referring now to FIGS. 6 to 9, the metal shield 7 includes a frame body 73 surrounding and mounted on the sleeve portion 60 of the insulative housing 6, and a reduced substantially D-shaped flange 74 projecting from the frame body 73 and surrounding the rectangular flange 63 of the insulating housing 6 and the front panel portions 46, 56 of the first and second terminal modules 4, 5. The frame body 73 has top and bottom faces, each is formed with a pair of tongues 731 that interlock with the locking recesses 66 of the sleeve portion 60 so as to secure the metal shield 7 to the insulative housing 6.

A plurality of first and second holes 400, 500 are respectively formed in the connecting portions 41, 51 of the first and secondseat bodies 40, 50 during molding process for the first and second seat bodies 40, 50. To prevent the first or second terminals 48, 58 from being dislocated in a mold cavity (not shown) by injection of a liquid crystal polymer for forming the first or the second seat bodies 40, 50 during the molding process, a plurality of partitioning posts (not shown) are used in the mold cavity to position the first or the second terminals 48, 58. The spaces occupied by the partitioning posts in the mold cavity result in the first and second holes 400, 500 in the connecting portions 41, 51 of the first and second seat bodies 40, 50. With the formation of the first and second holes 400, 500 in the connecting portions 41, 51 of the first and second seat bodies 40, 50, the amount of the liquid crystal polymer employed for forming the first and second seat bodies 40, 50 is significantly reduced.

Since the first and second terminals 48, 58 are molded with the first and second seat bodies 40, 50, the bending problem and the laborious work encountered in the prior art during manufacture are eliminated.

With the invention thus explained, it is apparent that various modifications and variations can be made without departing from the spirit of the present invention. It is therefore intended that the invention be limited only as recited in the appended claims.

I claim:

1. An electrical connector comprising:

a first terminal module including a row of first terminals and an insulative first seat body molded over said first terminals, said first terminals having contact portions exposed at one side of said first seat body;

a second terminal module including a row of second terminals and an insulative second seat body molded over said second terminals, said second terminals having contact portions exposed at one side of said second seat body, said second seat body being stacked on said first seat body with said sides respectively facing upward and downward;

a coupling member disposed on and coupling said first and second seat bodies;

an insulative housing having a sleeve portion receiving said first and second terminal modules, said contact portions of said first and second terminals projecting outwardly from said sleeve portion;

a retaining member disposed on said housing for positioning said first and second seat bodies to said housing; and a metal shield surrounding said sleeve portion and said contact portions of said first and second terminals.

2. An electrical connector comprising:

a first terminal module including a row of first terminals and a one-piece insulative first seat body molded over said first terminals, said first terminals having contact portions exposed at one side of said first seat body;

a second terminal module including a row of second terminals and a one-piece insulative second seat body molded over said second terminals, said second terminals having contact portions exposed at one side of said second seat body, said second body being stacked on said first seat body with said sides of said first and second seat bodies facing away from each other in opposite directions;

a coupling member disposed on and coupling said first and second seat bodies;

an insulative housing having a sleeve portion receiving said first and second terminal modules, said sleeve portion having a top side above said first terminal module, a bottom side below said second terminal module, and front and rear open ends; and a retaining member disposed on said insulative housing for positioning said first and second terminal modules to said housing;

said first and second seat bodies including front panel portions inserted snugly into said sleeve portion and projecting forward from said front open end, and rear panel portions disposed opposite to said front panel portions and extending out of said rear open end, said front panel portions holding said contact portions of said first and second terminals.

3. The electrical connector as claimed in claim 2, wherein said insulative housing further includes two frame members projecting rearwardly from said rear open end at two opposite ends of said sleeve portion, each of said first and second seat bodies further having a connecting portion interconnecting and projecting from said front and rear panel portions, said connecting portion being inserted snugly between said frame members, and having a shoulder face abutting against said rear open end of said sleeve portion.

4. The electrical connector as claimed in claim 3, wherein said retaining member is disposed on said frame members to engage at least one of said connecting portions of said first and second seat bodies.

5. The electrical connector as claimed in claim 4, wherein said connecting portion of said first seat body has a top side substantially flush with top sides of said frame members, said connecting portion of said second seat body having a bottom side substantially flush with bottom sides of said frame members.

6. The electrical connector as claimed in claim 2, wherein said front panel portion of said second seat body has a front edge flanged upward from one end thereof to a front end of said front panel portion of said first seat body.

7. The electrical connector as claimed in claim 6, wherein said front edge has a height substantially equal to the thickness of said front panel portion of said first seat body, said front edge having a guide face slanting in a front-to-rear direction.

8. The electrical connector as claimed in claim 3, wherein said coupling member includes interengaging projections and recesses which are disposed on confronting surfaces of said connecting portions of said first and second seat bodies.

9. The electrical connector as claimed in claim 4, wherein said retaining member includes two barb elements respectively formed on and projecting inwardly and oppositely from said frame members, said barb elements being spaced apart from said rear open end and having shoulders facing toward said rear open end, and slanting faces extending rearwardly of said shoulders.

10. The electrical connector as claimed in claim 9, wherein each of said first and second seat bodies has two first wedges respectively formed on two opposite ends of the corresponding connecting portion and interlocking with said shoulders.

11. The electrical connector as claimed in claim 10, wherein each of said first and second seat bodies further has second wedges respectively formed on said two opposite ends of the corresponding connecting portion, said second wedges being disposed rearwardly of and spaced from said first wedges to abut against said slanting faces.

12. The electrical connector as claimed in claim 2, further comprising a metal shield surrounding said sleeve portion and said front panel portions of said first and second seat bodies.

* * * * *